US005667181A

United States Patent [19]

van Leeuwen et al.

[11] Patent Number: 5,667,181

[45] Date of Patent: Sep. 16, 1997

[54] HANGER

[75] Inventors: Martin van Leeuwen, Tilburg; Geradus Emanual Cornelus Van Gijsel, Goirle, both of Netherlands

[73] Assignee: Erico International Corporation, Solon, Ohio

[21] Appl. No.: 423,524

[22] Filed: Apr. 17, 1995

[30] Foreign Application Priority Data

Apr. 18, 1994 [GB] United Kingdom ..... 9407653.6

[51] Int. Cl.[6] ..... F16L 3/12

[52] U.S. Cl. ..... 248/343; 52/39; 52/712; 248/58

[58] Field of Search ..... 52/712, 709, 711, 52/714, 39; 248/59, 317, 327, 58, 222.12, 320, 343

[56] References Cited

U.S. PATENT DOCUMENTS

| | | | |
|---|---|---|---|
| 948,902 | 2/1910 | Noyes . | |
| 1,056,028 | 3/1913 | Kehm | 248/59 X |
| 1,690,941 | 11/1928 | Nickerson . | |
| 2,375,513 | 5/1945 | Bach | 248/59 |
| 3,874,035 | 4/1975 | Schuplin | 248/327 X |
| 3,979,094 | 9/1976 | Dewitt | 248/60 |
| 3,995,823 | 12/1976 | Hensel | 248/327 |
| 4,041,657 | 8/1977 | Schuplin | 52/39 |
| 4,078,752 | 3/1978 | Kindorf | 248/59 X |
| 4,236,688 | 12/1980 | Wilk | 248/71 |
| 4,305,557 | 12/1981 | Kowalski | 248/59 X |
| 4,461,440 | 7/1984 | Heath | 248/59 |
| 4,934,634 | 6/1990 | Breeden, Jr. et al. | 248/59 |
| 5,203,529 | 4/1993 | Penniman | 248/228 |
| 5,228,256 | 7/1993 | Dreveny | 52/543 |

FOREIGN PATENT DOCUMENTS

| | | |
|---|---|---|
| 1288753 | 9/1991 | Canada . |
| 3539373 | 6/1986 | Germany . |
| 9107958 | 9/1991 | Germany . |

OTHER PUBLICATIONS

Erico Products Catalog, 1973, "Caddy Deck Clamps", 248–59.

*Primary Examiner*—Michael Safavi
*Attorney, Agent, or Firm*—Renner, Otto, Boisselle, Sklar

[57] ABSTRACT

A trapezium and like structure spring metal hanger clip includes two upwardly extending legs which are interconnected at their lower ends by a short bottom section. One leg at its top includes a generally horizontal arm extending toward the top of the other leg and adapted to be positioned through a hole in the top of the other leg. The horizontal arm is generally channel shape in sectional configuration and the upper edge includes serrations adapted to engage the upper edge of the hole in the top of the other leg, to prevent the clip from being sprung open without the other leg moving upwardly with respect to the arm. The clip may be sprung open in one form and the horizontal arm inserted through the trapezium and like structure and into the hole at the top of the other leg. In this manner both legs are supported by the horizontal arm. In another form, the clip is already open. A nut is snapped into place between the legs at the lower end and held against vertical movement and rotation. The tapped hole of the nut is aligned with a hole in the short bottom section, so that a threaded rod may be inserted into the nut from below without a ladder.

23 Claims, 3 Drawing Sheets

HANGER

BACKGROUND OF THE INVENTION

In construction, floor and roofs are often constructed with metal decking which may enclose insulation. The decking is provided with ribs; usually ribs with symmetrical yet non-parallel side walls. Because of the rib configuration, the decking is termed a trapezium. The decking will usually form the unfinished ceiling of the space below. It is necessary and common to hang utilities such as plumbing, wiring, air ducts, and other items such as a finished ceiling from the trapezium.

Hangers for such purposes usually engage a hole or tang punched from the non-parallel side walls or bottom of such ribs. The hanger may then simply be hooked into or on the hole or tang. However, load capacity is poor.

One type of hanger employed with good load capacity is similar to a clevis. Holes are punched in the side walls of the trapezium and a U-shape hanger is supported by an elongated bolt inserted through such holes and holes in the upper ends of the legs of the hanger. The legs of the hanger straddle the trapezium rib. The hanger is held in place, for example, by a head on one end of a bolt and a nut and washer on the other end, or a threaded rod with two nuts. The bight portion of the hanger is provided with a hole, thread form, nut, key slot, or other similar device for affixing something to be hung from the bottom of the hanger, using for example, plain or threaded rod, wire, or other forms of clips or clamps.

Some of the problems of such a hanger are its cost, its multiple parts, and its difficulty of installation. Such hangers have a minimum of three parts and may have five or more, depending on whether a separate fixing device or washer is employed. Since the installation is usually done on a scaffold or step ladder, loose parts can be a problem. Even if all of the parts as a set are packaged, the opening of the package and assembly of the parts can be a problem. If one of the parts drops or rolls away, the installer has to climb down to retrieve the part, if it can be found, or get another package. Multiple part fasteners always take more time to install, and are more costly, especially if packaged.

It would accordingly be desirable to have the advantages of a clevis type hanger without the multiple parts or added cost.

SUMMARY OF THE INVENTION

A trapezium and like structure spring metal hanger clip includes two upwardly extending legs which are interconnected at their lower ends by a short bottom section. One leg at its top includes a generally horizontal arm extending toward the top of the other leg and in position through a hole in the top of the other leg, and substantially beyond. The clip in one form may be opened and the horizontal arm inserted through the trapezium and like structure and into the hole at the top of the other leg. In this manner both legs are supported by the horizontal arm. The clip is designed to prevent the clip from being sprung open under load without the other leg moving upwardly with respect to the arm. Accordingly, any load has to be removed from the hanger before it can be opened. The natural spring configuration of the clip is such that the other leg extends generally vertically or substantially perpendicular to the arm so that the interior of the clip forms almost a right triangle. In this manner, the clip is biased to the closed position and force against such bias is required to open the clip. Further, to ensure that the clip cannot be opened without the load relief and sufficient force to overcome the natural bias of the clip, the upper edge of the arm is serrated or provided with a saw tooth pattern which engages automatically with the upper edge of the hole in the other leg, and because of the bias, at the closest position of the leg to the structure. Accordingly, the clip is both self locking and self closing, with minimal guiding from the installer. In another form, the clip is already open and need not be sprung open before inserting the arm.

A nut is snapped into place between the legs at the lower end and held against vertical movement and rotation. The tapped hole of the nut is aligned with a hole in the short bottom section, so that a threaded rod may be inserted into the nut from below without a ladder. The lower end of the legs just above the short bottom section are provided with centered inwardly directed spring tabs. The tabs are struck from the legs but are slightly narrower than the struckout portion so a narrow slot is provided on each side of the tab which slots are open beneath the tab to the short bottom section. In one form the tabs are grooved. In another form, only one leg is provided with a tab while the other has a hole to receive a corner of the nut.

Accordingly, a square nut of the proper exterior dimension may be simply pressed down with diagonally opposite corners in such grooves. The tabs will snap over such corners and the nut corners will center themselves under the tabs on the short horizontal section. Alternatively, the nut corners may be guided by the slots. The nut is then held against vertical and rotational movement. In such another form, a hole in one leg receives a corner of the nut while the opposite corner snaps under the tab in the other leg. When the clip is opened for fixing onto the decking, the tabs will prevent the nut from falling out, since the tabs are not subject to the bending forces applied to the clip during installation. The size of the tapped hole in the nut aligned with the hole in the short section may vary. In any event, the snap assembly permits a threaded rod or stud to be inserted from below without again using a ladder or scaffold.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
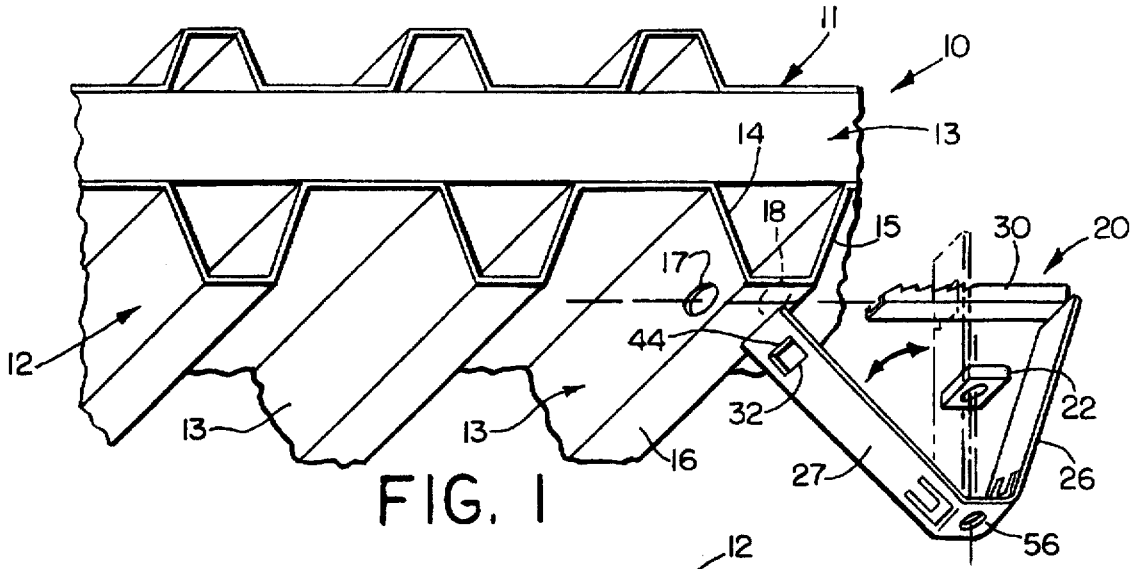
FIG. 1 is a fragmentary perspective exploded view of trapezium decking with the hanger clip of the present invention open and about to be installed.

Referring initially to FIG. 1, there is illustrated trapezium decking shown generally at 10 which may include ribbed upper decking 11, somewhat more deeply ribbed lower decking 12, and insulation 13 therebetween. The configuration of the ribs 13 of the deck 12, from which the name trapezium derives are in the sectional configuration of a rectangular quadrilateral which is not a parallelogram. The non-parallel sides of the ribs 13 seen that 14 and 15 are however of equal length and are symmetrical to a vertical plane through the center of the rib. Accordingly, the side walls of the rib extend symmetrically at an angle to the somewhat more narrow bottom 16 of the rib. As illustrated in FIG. 1, two holes indicated at 17 and 18 horizontally aligned have been provided in the walls 14 and 15, respectively, of the rib. The holes may be formed with a punch, or drill, for example. FIG. 1 also illustrates the hanger clip of the present invention shown generally at 20 open and ready to install on the decking. Such figure also illustrates square nut 22 which may be assembled with the hanger and threaded rod or stud 24 which may then be inserted in the nut from below without the deployment of a ladder or scaffold. The details of the construction hanger 20 are shown more clearly in FIGS. 2, 3 and 4.

Referring now in addition to such figures, it will be seen that the hanger 20 includes a first generally vertical yet inclined leg 26 and a second vertically extending leg 27 interconnected at their lower ends by a short horizontal section 28. The top of the leg 26 is somewhat shorter than the leg 27 and is formed with a horizontally extending arm 30 which extends toward the arm 27 and through rectangular hole 32 in the top of such arm and substantially there beyond. The arm 30 is about the same length as leg 26. The arm is integrally formed with the top of the leg 26 and is a general channel shape. This shape is seen more clearly in FIG. 4. The bottom of the arm is somewhat rounded as indicated at 34 and the legs of the channel seen at 35 and 36 tend to flair slightly outwardly. The sectional configuration of the arm is somewhat tubular and in fact a generally tubular configuration may be employed.

Figure 2:
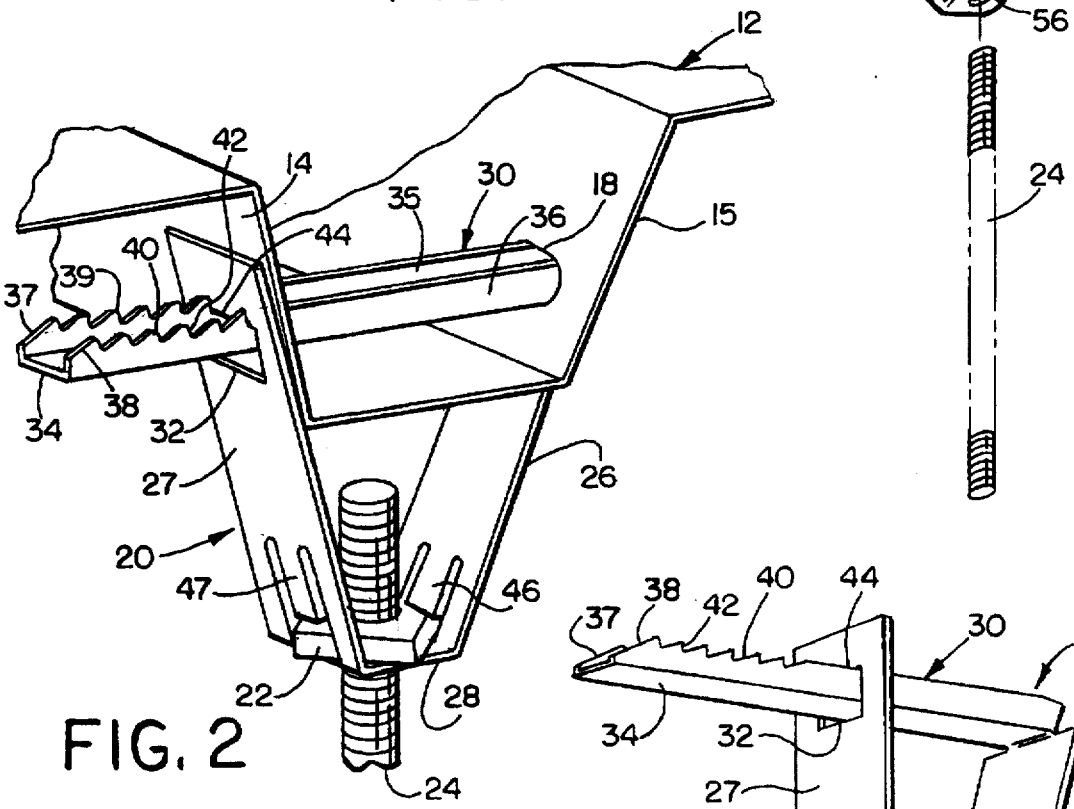
FIG. 2 is an enlarged perspective view of the hanger installed.

As seen more clearly in FIG. 2, the upper distal edges of the legs of the arm are provided with angular pilot edges indicated at 37 and 38, respectively. The upper edges inwardly of the pilot edges are each provided with a saw tooth or serrated configuration seen at 39 and 40, respectively. Each serration includes an almost right angle stop shoulder seen at 42. The purpose of such serrations is to engage and lock against the upper horizontal linear edge 44 of the rectangular hole 32 in the arm 27. This locking engagement is seen in FIG. 2.

Figure 3:
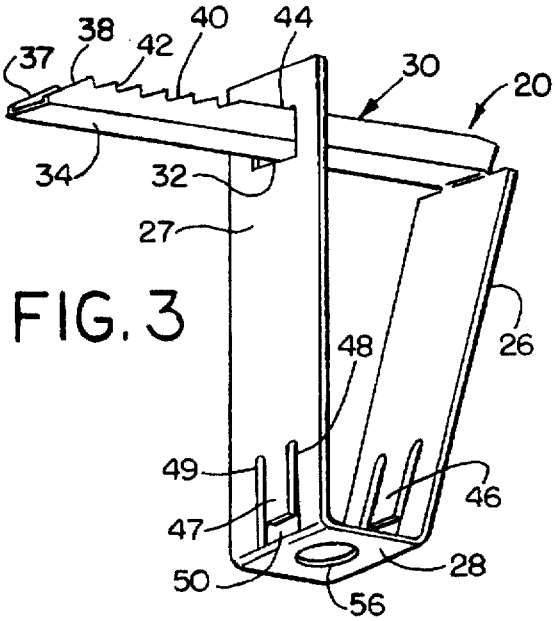
FIG. 3 is a similar view of the hanger in its closed substantially unbiased state.
Figure 4:
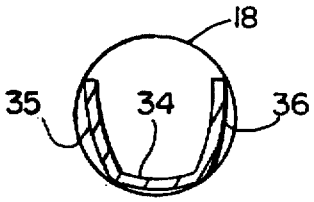
FIG. 4 is an enlarged vertical section through the arm showing the sectional configuration of the arm and the hole in the trapezium.
Figure 5:
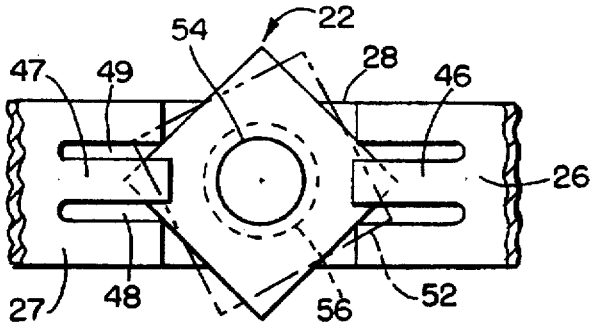
FIG. 5 is an enlarged fragmentary top plan view of the nut installed in the bottom of the hanger.

Referring now additionally to FIG. 5, it will be seen that the lower end of each leg is provided with a slightly inwardly projecting downwardly pointing spring tab, such tabs being seen at 46 and 47 for the legs 26 and 27, respectively. As also seen in FIG. 3, when the tabs are struck out during manufacture of the hanger clip, such tabs are surrounded by a generally U shape opening which includes two slots 48 and 49 on either side of the tab 47, for example, such slots opening to the clearance hole 50 at the bottom of the leg between the horizontal portion 28 and the lower end of the tab. In this manner, the square nut indicated in FIG. 5 can be positioned at the bottom of the hanger clip with the diagonally opposite corners in the diagonally opposite slots as indicated by the phantom line position 52. Then by simply pushing down on the nut, the corners will automatically center themselves with respect to the openings 50, snapping beneath the tabs. The lower edges of the tabs hold the nut on the section 28 against vertical movement while the engagement of the corners of the nut within the openings 50 keeps the nut from rotating. As illustrated, the tapped hole 54 in the nut is aligned with hole 56 in the short horizontal section 28.

Figure 8:
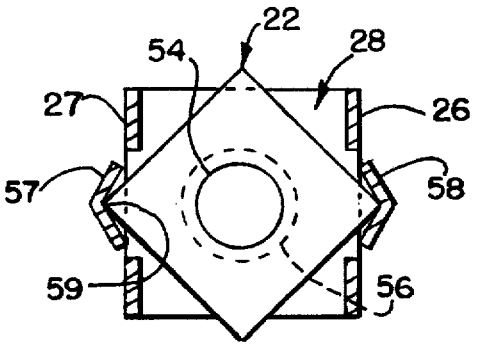
FIG. 8 is a view similar to FIG. 7 showing an alternative form of tab arrangement.

As seen in FIG. 8, as an alternative, the tabs 57 and 58 may each be provided with grooves indicated at 59 which receive a corner of the nut and hold the nut in position as it is pushed down. In both forms, the slots on each side of the tabs enable the tabs to bend freely and isolate the tabs from bending forces on the legs.

The nut may, for example, have an external dimension of 17×17 mm, with a thickness of 5 mm, but the diameter of the tapped hole in the nut may vary to accommodate hanging devices of different external thread diameter. It will also be appreciated that a wide variety of other types of hanging devices may be employed in connection with the short horizontal section 28. For example, a variety of hooks or tie wires or like fasteners may be suspended from the lower end of the clip.

Figure 6:
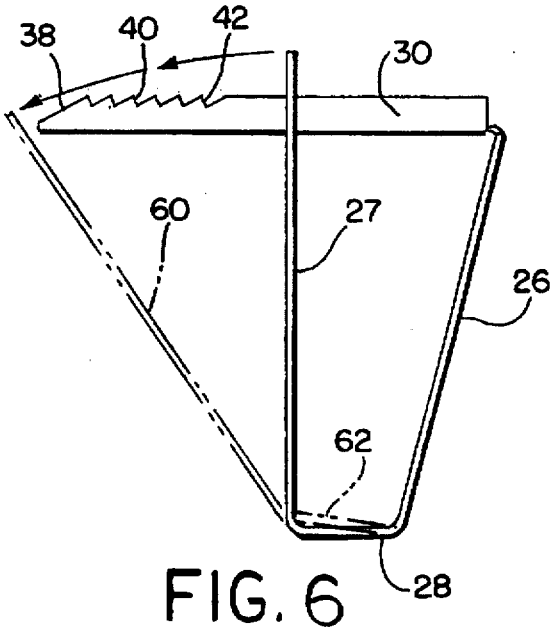
FIG. 6 is an elevation of the hanger illustrating how it has to be opened with intentional force.
Figure 7:
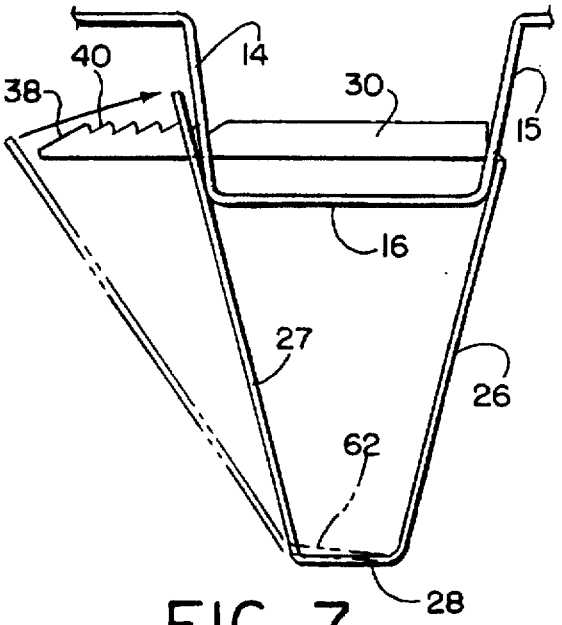
FIG. 7 similar elevation illustrating the self closing and locking feature of the invention.

Referring now to FIGS. 3, 6 and 7, it will be seen that FIGS. 3 and 6 illustrate the hanger clip in its unbiased closed condition. The hanger clip is made of spring metal and in order to be opened as seen in FIG. 6, a force must be applied to the leg 27 to move it outwardly to the phantom line position 60. This position is seen also in FIG. 1. If released, the leg tends to spring back to its unbiased or vertical position. In the unbiased position, the leg 27 is almost perpendicular to the arm 30 and accordingly the interior of the hanger clip forms almost a right triangle. It is also noted that in order for the hole 32 at the top of the leg 27 to clear the projecting distal end of the arm 30, either the arm must deflect downwardly or the bottom of the clip has to be elevated slightly as indicated generally at 62 with respect to the arm 30. When the leg 27 is released after installation, it will spring back to its position seen in FIG. 7 abutting the side of the trapezium configuration channel. The saw tooth serrations engage the upper edge 44 of the hole 32 locking the hanger in place. When the clip is loaded, this arm can't be deflected downwardly. In this manner, to release the hanger clip from the position shown in FIG. 2, not only must the bias of the clip be overcome by intentional force, but the load on the clip must be relieved to enable the leg 27 to move to the position 60 seen in FIGS. 6, 7 or 1.

Accordingly, as seen in FIGS. 1 and 6, the hanger clip can only be opened by an intentional force, and when installed, only by relieving the load on clip. The saw tooth pattern on top of the horizontal arm engages automatically with the upper part of the rectangular hole in the leg 27, and because of the spring configuration of the clip, at the closest position to the structure as seen in FIG. 7.

Figure 9:
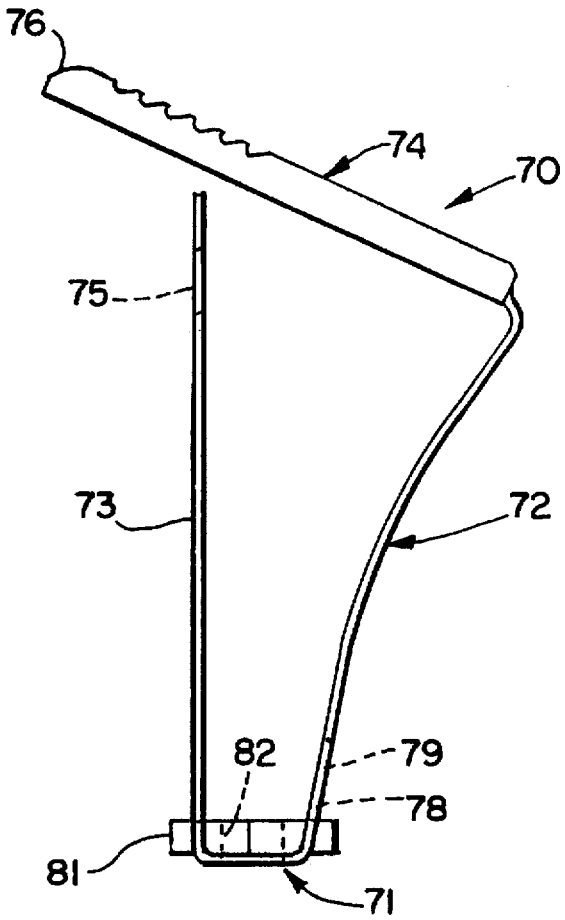
FIG. 9 is an edge elevation of an open form of hanger clip also in accordance with the present invention.
Figure 10:
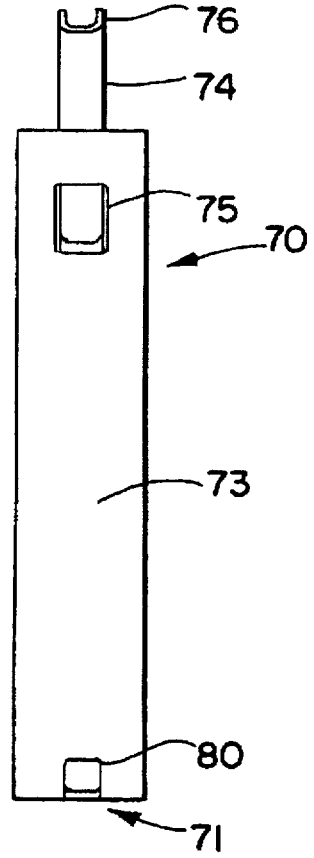
FIG. 10 is a side elevation of such clip as seen from the left hand side of FIG. 9.
Figure 11:
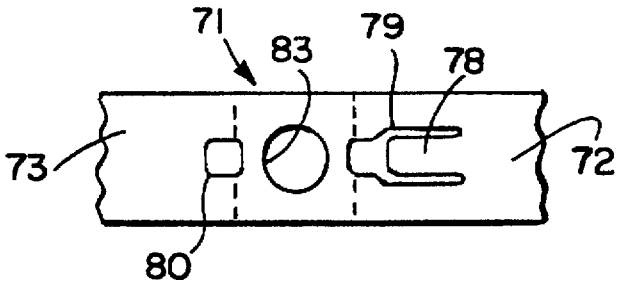
FIG. 11 is a fragmentary developed view of the bottom, of the hanger illustrating the various holes before the legs are formed.

In FIGS. 9, 10 and 11, there is illustrated a modified form of hanger clip which in its unbiased position is open. The clip shown generally at 70 includes a bottom 71, a slightly outwardly bowed leg 72, a vertical leg 73 and arm 74 extending from the top of leg 72 and adapted to be inserted through hole 75 in the top of vertical leg 73. In the unbiased position illustrated, the arm 74 extends horizontally yet upwardly at an angle and just clears the top of the leg 73.

This clip does not need to be opened before installation but may be installed in the same manner as the other embodiment once opened. The spring nature of the clip enables the legs readily to be separated and the distal end of the arm seen at 76 to be inserted through the holes in the trapezium. The distortion of the legs also enables the hole 75 to be placed on the projecting end of the arm, and when released, the clip returns to the position substantially as seen in FIG. 7.

It is also noted that the embodiment of FIGS. 9–11 has only one spring tab 78 to hold the square nut. The tab is formed by U-shape hole 79 in the bottom of leg 72 while the bottom of leg 73 is provided with a small rectangular hole 80 to capture a corner of square nut 81. The tapped hole 82 in the nut is aligned with hole 83 in the bottom 71. The nut is thus held against vertical movement or rotation.

When installed, the somewhat rounded bottom wall of the channel configuration arm in either embodiment enables the hanger clip to swivel or pivot about the axis of the arm. Swivel in the opposite direction may be obtained by using, for example, a rounded bottom on the hanger, cooperating with a saddle nut. Accordingly the vertical axis of the rod or any other intermediate hanging fixation, does not need necessarily to be plum.

It can now be seen that there is provided a low cost easy to install one piece hanger clip. There is no assembly required in production although the installer may desire to insert the nut before mounting the ladder or scaffold. There is thus no chance of losing a part while mounting the clip to the trapezium decking. The clip has the swivel facility about the axis of the arm and also the advantage of load bearing by two holes in the deck.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A construction hanger comprising a pair of upwardly diverging legs interconnected at their lower ends by a short bottom section from which a load is hung, one leg at its upper end including a generally horizontal arm extending toward the top of the other leg, a hole in the top of the other leg, and said arm being adapted to extend through said hole in the top of said other leg whereby both legs are supported by the arm when the arm is inserted through a fixed structure and into said hole at the top of said other leg.

2. A hanger as set forth in claim 1 including a vertical hole in said bottom section, and means on said hanger at the lower end of said legs to capture and retain a nut on said bottom section with the tapped hole of the nut aligned with said vertical hole, whereby a rod may be threaded into said nut from below.

3. A hanger as set forth in claim 1 wherein said hanger is a spring metal clip and in the unbiased position of said clip, said other leg extends substantially perpendicular to said arm when said arm projects through said hole.

4. A hanger as set forth in claim 1 wherein the top of said arm is serrated and engages an edge of said hole when said clip is closed.

5. A hanger as set forth in claim 4 wherein said arm is generally channel shape, the edge of the legs of said channel being serrated to lock against the edge of the hole.

6. A hanger as set forth in claim 3 wherein said arm extends substantially beyond said other leg in said unbiased position when inserted through said hole.

7. A hanger as set forth in claim 6 wherein the end of said bottom adjoining said other leg requires deflection toward said arm before said other leg may be forced off said arm and the clip opened after said clip is installed.

8. A hanger as set forth in claim 2 including a spring tab at the lower end of at least one leg struck from a slot, said tab being adapted to snap above the nut as the nut is pushed toward said bottom section to hold the nut from vertical movement with respect to said hanger.

9. A hanger as set forth in claim 8 including spring tabs at the bottom end of each leg adapted to snap above the nut.

10. A hanger as set forth in claim 8 wherein said tab is provided with a groove to engage a corner of the nut as the nut is pushed down.

11. A hanger as set forth in claim 1 wherein said hanger is a spring metal clip and in the unbiased position of the clip, said arm extends horizontally from said one leg and at an angle upwardly to extend over the top of said other leg.

12. A hanger as set forth in claim 11 wherein said one leg is bowed.

13. A construction hanger comprising a pair of upwardly diverging legs interconnected at their lower ends and including means at their upper ends to support said hanger from a fixed structure, and a short bottom section interconnecting said legs at their lower ends, a vertical hole in said bottom section, and means on said hanger at the lower end of said legs to capture and retain a nut on said bottom section with the tapped hole of the nut aligned with said vertical hole, whereby a rod may be threaded into said nut from below, one leg at its upper end including a horizontal arm extending toward the top of the other leg, a hole at the top of said other leg, and said arm being adapted to extend through said hole at the top of said other leg whereby both legs may be supported by the arm when the arm is inserted through a fixed structure and said hole at the top of said other leg.

14. A hanger as set forth in claim 13 including a spring tab at the lower end of at least one leg struck from a slot, said tab being adapted to snap above the nut as the nut is pushed toward said bottom section to hold the nut from vertical movement with respect to said hanger.

15. A hanger as set forth in claim 14 including spring tabs at the bottom end of each leg adapted to snap above the nut.

16. A hanger as set forth in claim 14 wherein said tab is provided with a groove to engage a corner of the nut as the nut is pushed down.

17. A hanger as set forth in claim 13 wherein said hanger is a spring metal clip and in the unbiased position of said clip, said other leg extends substantially perpendicular to said arm when said arm projects through said hole at the top of said other leg.

18. A hanger as set forth in claim 17 wherein the top of said arm is serrated and engages an edge of said hole at the top of said other leg when said clip is closed.

19. A hanger as set forth in claim 18 wherein said arm is generally channel shape, the edge of the legs of said channel being serrated.

20. A hanger as set forth in claim 17 wherein said arm extends substantially beyond said other leg in said unbiased position.

21. A hanger as set forth in claim 20 including a spring tab at the lower end of each leg struck from a slot, said tabs being adapted to snap above the nut as the nut is pushed toward said bottom section to hold the nut from vertical movement with respect to said hanger.

22. A hanger as set forth in claim 13 wherein said hanger is a spring metal clip and in the unbiased position of the clip, said arm extends horizontally from said one leg and at an angle upwardly to extend over the top of said other leg.

23. A hanger as set forth in claim 22 wherein said one leg is bowed.

* * * * *